US008026669B2

(12) United States Patent
Kawasaki et al.

(10) Patent No.: US 8,026,669 B2
(45) Date of Patent: Sep. 27, 2011

(54) DISPLAY DEVICE

(75) Inventors: Somei Kawasaki, Saitama (JP); Masami Iseki, Yokohama (JP); Tatsuhito Goden, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 986 days.

(21) Appl. No.: 11/693,918

(22) Filed: Mar. 30, 2007

(65) Prior Publication Data

US 2007/0229554 A1 Oct. 4, 2007

(30) Foreign Application Priority Data

Mar. 31, 2006 (JP) ..... 2006-098012

(51) Int. Cl.
*G09G 3/30* (2006.01)

(52) U.S. Cl. ..... 315/169.3; 315/169.1; 345/76

(58) Field of Classification Search ..... 345/211, 345/204, 76–84, 90, 92, 98; 315/169.1, 169.2, 315/169.3; 313/498, 506, 509
See application file for complete search history.

(56) References Cited

U.S. PATENT DOCUMENTS

| | | | | |
|---|---|---|---|---|
| 5,822,026 | A * | 10/1998 | Matsuo | 349/38 |
| 5,897,182 | A * | 4/1999 | Miyawaki | 349/43 |
| 6,768,482 | B2 | 7/2004 | Asano et al. | 345/90 |
| 6,847,343 | B2 * | 1/2005 | Anzai | 345/90 |
| 7,212,195 | B2 * | 5/2007 | Kawasaki | 345/204 |
| 7,601,994 | B2 * | 10/2009 | Fukuchi et al. | 257/211 |
| 7,605,784 | B2 * | 10/2009 | Suh et al. | 345/83 |
| 2004/0066357 | A1 | 4/2004 | Kawasaki | 345/76 |
| 2007/0229428 | A1 | 10/2007 | Nakagawa et al. | 345/92 |

* cited by examiner

*Primary Examiner* — Jacob Y Choi
*Assistant Examiner* — Ephrem Alemu
(74) *Attorney, Agent, or Firm* — Fitzpatrick, Cella, Harper & Scinto

(57) ABSTRACT

A display device includes a display unit in which display elements provided with pixel circuits are arranged so as to have a sequence of three different colors in a row direction and the colors are shifted in a column direction by 1.5 columns. A scanning line is provided in every row of the display unit, a signal line is provided in every column of the display unit, and a column control circuit outputs a display signal for every column. The positions of the pixel circuits are displaced in the row direction with respect to the arrangement of the display elements, and are thus aligned in the column direction and also connected to the signal line only on one side of the signal line. No inversion of the pixel circuit pattern occurs and variations of the circuit characteristics in every row are suppressed.

10 Claims, 9 Drawing Sheets

PRIOR ART

PRIOR ART

DISPLAY DEVICE

BACKGROUND OF THE INVENTION

1. Field of the Invention

The present invention relates to an active matrix display device.

2. Description of the Related Art

An electroluminescence element (hereinafter referred to as EL element) is a light-emitting element for emitting light when a current is injected thereto. In an active matrix EL display device, EL elements are arranged in a matrix to form pixels, and pixel circuits are provided for supplying currents to the EL elements of the respective pixels.

The pixel circuits are controlled by scanning lines and signal lines. Each scanning line is commonly provided to pixel circuits arranged in a respective row. Through the connection to those pixel circuits, a signal for selecting the pixel circuit in every row is applied. The signal lines are connected to pixel circuits arranged in a respective column, and a signal corresponding to image information is applied.

US Patent Laid-Open No. 2004/0066357 proposes a pixel circuit in which two signal lines including a signal line for supplying a current signal and a signal line for supplying a voltage signal are provided.

There are two types for arrangement of the pixels, which are a stripe arrangement and a delta arrangement. According to the stripe arrangement, pixels are linearly arranged. According to the delta arrangement, three pixels of RGB which constitute a color display unit are arranged in a delta shape. In a small size display device whose pixel number is small, the delta arrangement is used for the pixel array in many cases for improving definition.

FIG. 6 shows an example of the delta arrangement. In the delta arrangement, pixels of RGB in the row direction are periodically arranged as one sequence, and the pixels adjacent to the pixels in the row direction are shifted in the arrangement sequence by 1.5 pixels.

In a color display device that employs the delta arrangement, an R pixel R1 and a G pixel G1 adjacent to each other in one row forms a pair with a B pixel B1 arranged immediately beneath the row to compose a color display unit. Then, a B pixel B2 adjacent thereto forms a pair with an R pixel R2 and a G pixel G2 immediately beneath the row to compose another color display unit.

In FIG. 6, scanning lines X1, X2, . . . and signal lines Y1, Y2, . . . are also drawn.

In a transmissive liquid crystal device, scanning lines and signal lines are arranged between a pixel and another pixel in order to increase a pixel aperture ratio. In a matrix display device that employs the delta arrangement, it is possible to arrange scanning lines straight through, but it is necessary to thread signal lines among the pixels in a bending manner. Moreover, in order that pixels of the same color are connected to each other by one signal line, connection points C1 and C2 with respect to the pixel circuit are located on the opposite sides in every row.

The connection positions with respect to the signal line are inverted in every row and thus the pixel circuit patterns are arranged so as to be inverted. For this reason, in a precise sense, variations every other row occur in characteristics of TFT elements that compose the pixel circuits. In order to have uniform display characteristics, it is desired to employ a uniform pixel circuit pattern without such inversion.

In a reflective liquid crystal display device or a top emission EL display device, pixel circuits do not block transmitted light, and it is therefore unnecessary to arrange signal lines between pixels and it is also possible to extend the signal lines straight through across the pixel region. However, in the EL display device, the pixel circuit needs to include a few transistors and a power source wiring whose width is large so that a large current flows. For this reason, if the pixel density becomes high, the pixel circuits occupy the entirety of the pixel area. In that case, it is difficult to arrange the signal lines straight through across near the center of the pixel region, and eventually the wiring is bent along a side of the pixel circuit pattern.

U.S. Pat. No. 6,768,482 proposes a top emission EL display device having pixels that are arranged in delta. In this device, a pitch of pixel array in a row direction is set two times larger than a pixel circuit pitch, and instead a pitch of pixel array in a column direction is set half of the pixel circuit pitch, whereby even when the pixels arranged in delta, it is possible to arrange pixel circuits straight through in a stripe manner. Also, it is possible to arrange the signal lines straight through without bending.

However, if the pixel array pitch is further decreased, the pixel circuits need to be arranged at a density two times larger than the degree of decreasing the pixel array pitch. Thus, it is necessary to extremely decrease the sizes of transistors and wirings that compose the pixel circuits. The sizes of the circuit elements and the wiring have lower limits so as to ensure fabrication yield, and setting the pixel circuit pitch smaller than the pixel pitch causes unnecessary disadvantages at the time of pursuing the high definition.

SUMMARY OF THE INVENTION

The present invention solves the above-described problems.

A display device according to an aspect of the present invention in which a plurality of pixels are arranged in a row direction and a column direction includes: display elements expressing one of a plurality of colors and composing a pixel, the display elements being arranged in the row direction so as to express colors in a periodic arrangement which is shifted with respect to an adjacent row by a pixel pitch multiplied by a non-integer; pixel circuits that drive the respective display elements; scanning lines that transmit a row selection signal to the pixel circuits; and signal lines that transmit a display signal to the pixel circuits, wherein: each of the pixel circuits includes a plurality of circuit elements which are arranged in an area with a same pattern at least in the column direction, and the pixel circuits are displaced in opposite directions mutually in adjacent rows relative to the display elements and thus align in the column direction; and the signal lines are straight-line wirings extending in the column direction in a region where the display elements are arranged, and are connected only to pixel circuits aligning in one column along which the respective signal lines are extending.

The display device of the present invention can simplify the circuit layout with respect to the pixels in the delta arrangement and eliminate the variations of the circuit characteristics, and thus the present invention can contribute to improvements in the high definition and the display quality of the active matrix display device.

Further features of the present invention will become apparent from the following description of exemplary embodiments with reference to the attached drawings.

DESCRIPTION OF THE EMBODIMENTS

Display Device Configuration

First of all, a description will be given of an active matrix color display device to which the present invention is applied.

The active matrix display device is formed by arranging display units in a row direction and a column direction. The display unit in a color display is composed of display elements of three colors, and each of the display elements expresses one of red, blue, and green (RGB).

In the following description, the three display elements composing the display unit are arranged in a delta shape, and display elements in an adjacent row are shifted by an amount 1.5 larger than a pixel pitch in the row direction.

In the active matrix display device, each of the display elements is provided with a driver circuit. Hereinafter, the individual display element is referred to as a pixel, and a circuit for driving the pixel is referred to as a pixel circuit. In many of organic EL display devices, the pixel circuit is located on a different layer from the display element on a substrate and separated by an insulating layer.

Figure 3:
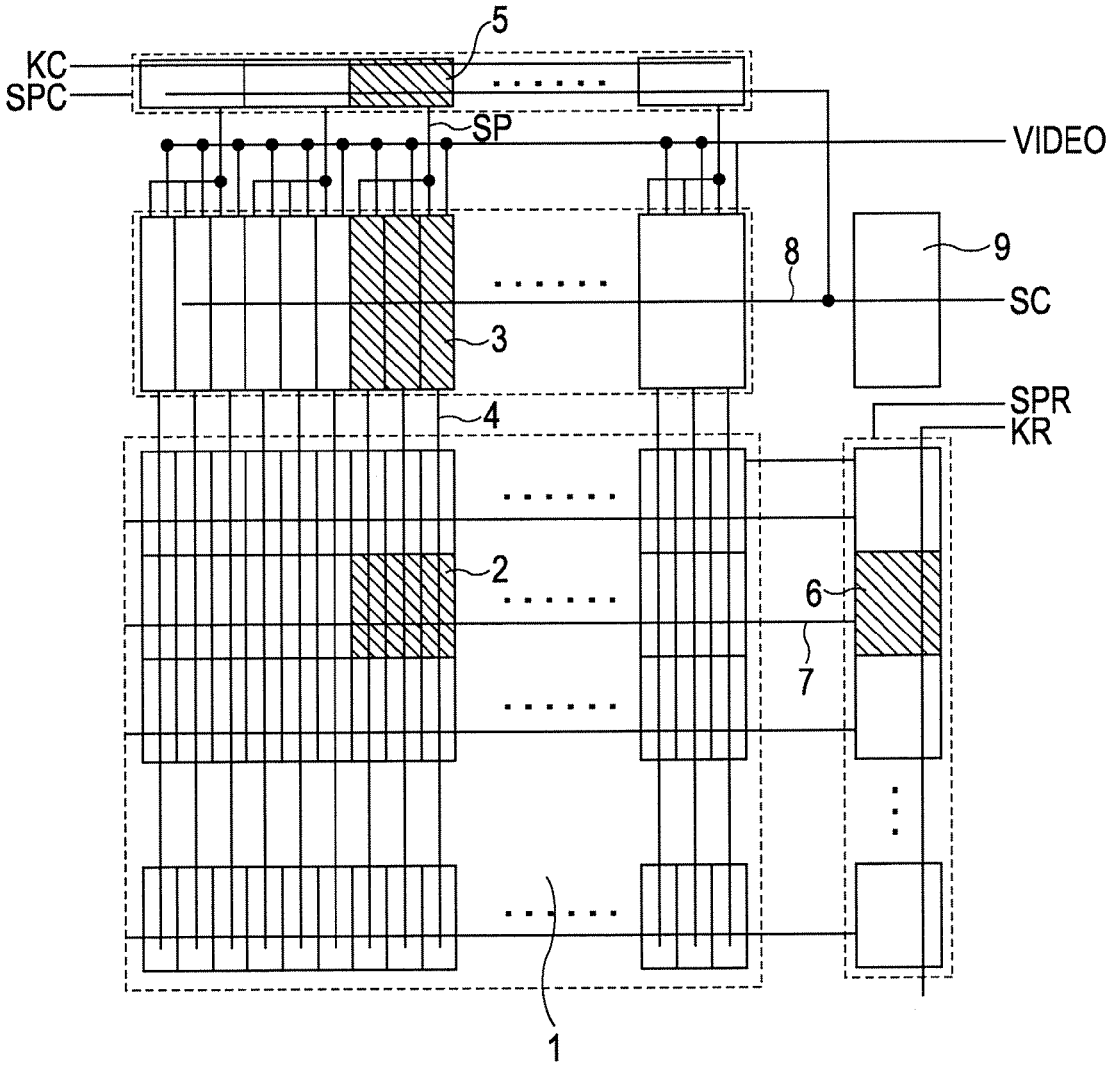
FIG. 3 is a schematic diagram of an active matrix display device.

FIG. 3 shows a circuit configuration of the active matrix display device.

Arrangement of the pixel circuit 2 constitutes a display unit 1 as a whole. The pixel circuits 2 are arranged in matrix and a signal line 4 and a scanning line 7 in a corresponding column are connected to each of the pixel circuits 2.

In response to a control signal from the scanning line 7, pixel parts in the relevant row concurrently take a display signal supplied to the corresponding signal line 4 into the pixel circuit 2. After the scanning signal is shifted to the next row, a display element (not shown) connected to each of the pixel circuits 2 is caused to emit light at a luminance in accordance with the taken display signal.

The scanning signal of the respective scanning lines 7, that is a row selection signal, is generated at a row register 6. The row register 6 is a register that constitutes one stage of a row shift register, and is composed of the same number of shift registers as the rows to which a row clock KR and a row scanning start signal SPR are input.

The display signal for each column to be supplied to the respective signal lines 4 is generated by the same number of column control circuits 3 as the rows. In response to the display element of RGB three primary colors arranged in every three columns, the column control circuit 3 also outputs signals of three colors in the same sequence.

To the signal line 4 in each column, the column control circuit 3 in each column supplies a video signal VIDEO and a sampling signal SP, and a horizontal control signal 8 supplies a desired display signal.

A horizontal synchronism signal SC of the video signal VIDEO is input to a control circuit 9, thus generating the horizontal control signal at line 8.

The sampling signal SP is generated by a register (hereinafter referred to as column register) 5 of each stage of the shift registers whose number is ⅓ of the column control circuits 3. A column clock KC, a column scanning start signal SPC, and the horizontal control signal 8 for executing a reset operation of mainly the column register are input to the column register 5.

First Embodiment

Figure 4:
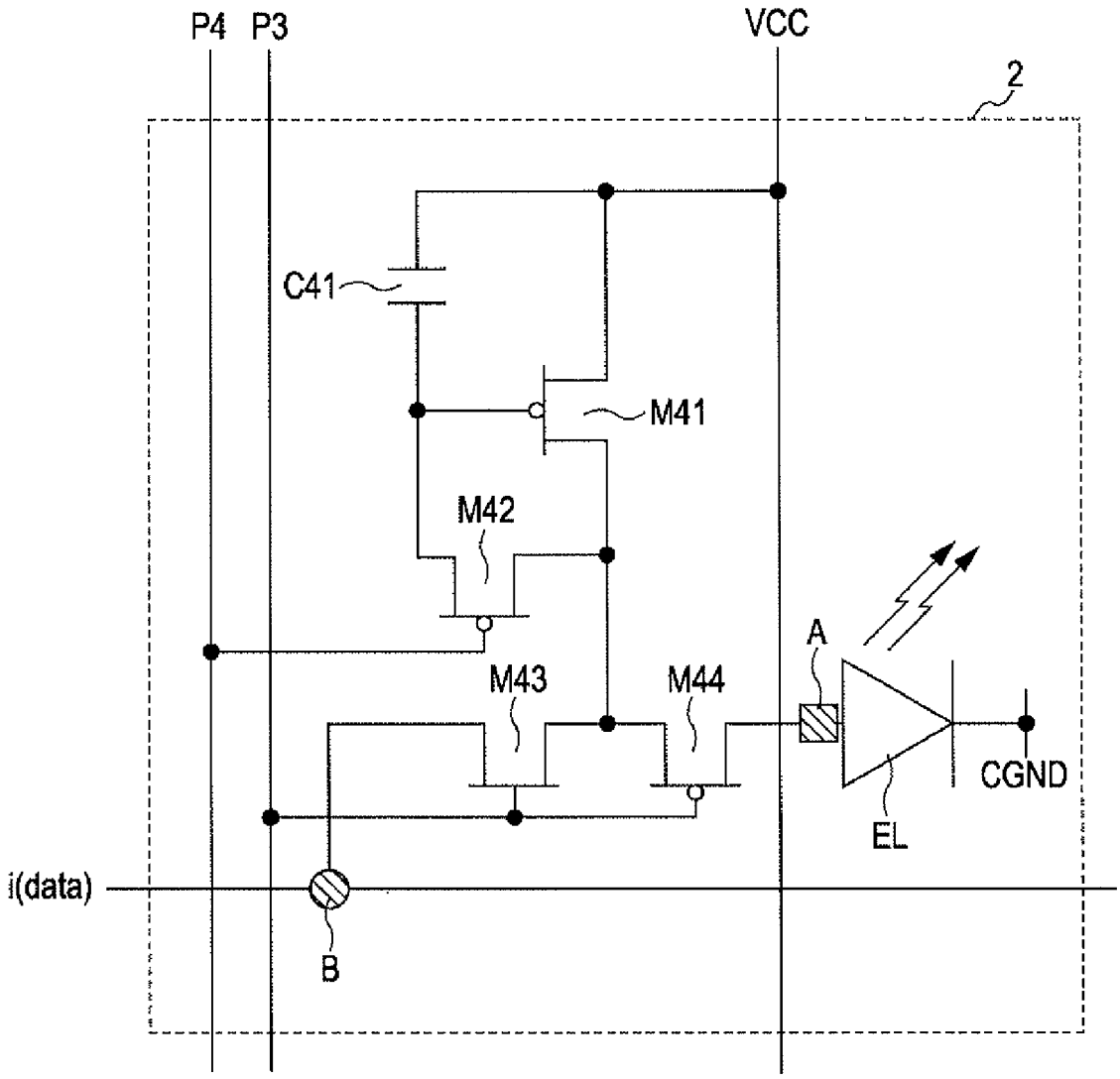
FIG. 4 shows a pixel circuit in which there is only one control line.

FIG. 4 shows a circuit which is disclosed as a pixel circuit example of the EL display device in US Patent Laid-Open No. 2004/0066357.

The pixel circuit 2 is composed of a driver TFT (M41) for controlling a driver current to be flown in the EL element, TFTs (M42, M43, and M44) functioning as switches, and a capacitance (C41) between gate-source terminals of the driver TFT. Furthermore, wirings include two scanning lines P3 and P4 and a power source line Vcc in the row direction (in a vertical direction in FIG. 4) and a signal line i(data) extending in the column direction (in a horizontal direction in FIG. 4). The power source Vcc may be extended in the column direction.

When a selection pulse is input to the scanning lines P3 and P4, the TFTs M42 and M43 are turned ON, and the TFT M44 is turned OFF. At this time, a signal current flows from the signal line i(data) into the driver TFT M41, and a voltage in accordance with the current is charged in the capacitance C41. When the scanning lines P3 and P4 are in a non-selected state, the TFTs M42 and M43 are turned OFF, and the TFT M44 is turned ON. A current in accordance with the voltage held at the capacitance C41 flows into EL via the driver TFT M41, whereby the EL element emits light.

In FIG. 4, the pixel circuit 2 is composed of three thin film transistors (hereinafter referred to as TFT), one capacitance, and three wirings including a scanning line, a signal line, and a power source line to be shared with other pixel circuits. In actuality, a contact area for achieving connections among these circuit elements needs to be prepared.

A in FIG. 4 denotes a terminal from which a current is injected to the EL element EL. The terminal is a connection part between a drain electrode of the TFT M44 and an anode of EL. B denotes a connection point where a current signal is supplied from the signal line i(data) to the pixel circuit 2.

Hereinafter, the present invention will be described by way of embodiments and comparison examples.

First Embodiment

1-1. Pixel Circuit

Figure 1A:
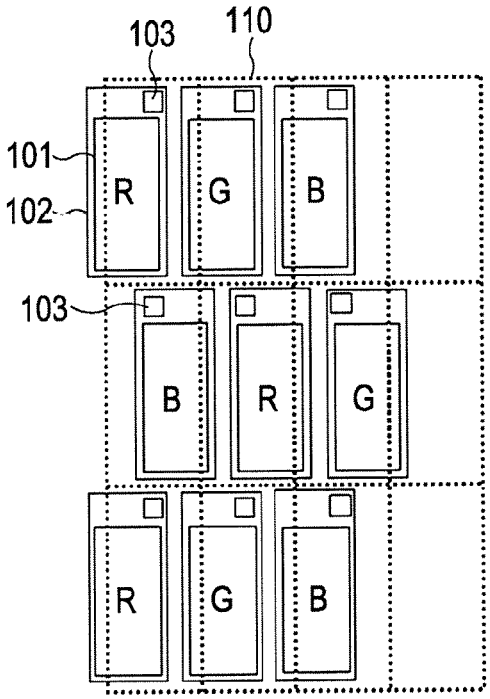
FIGS. 1A and 1B are arrangement drawings of pixel circuits according to a first embodiment of the present invention.
Figure 1B:
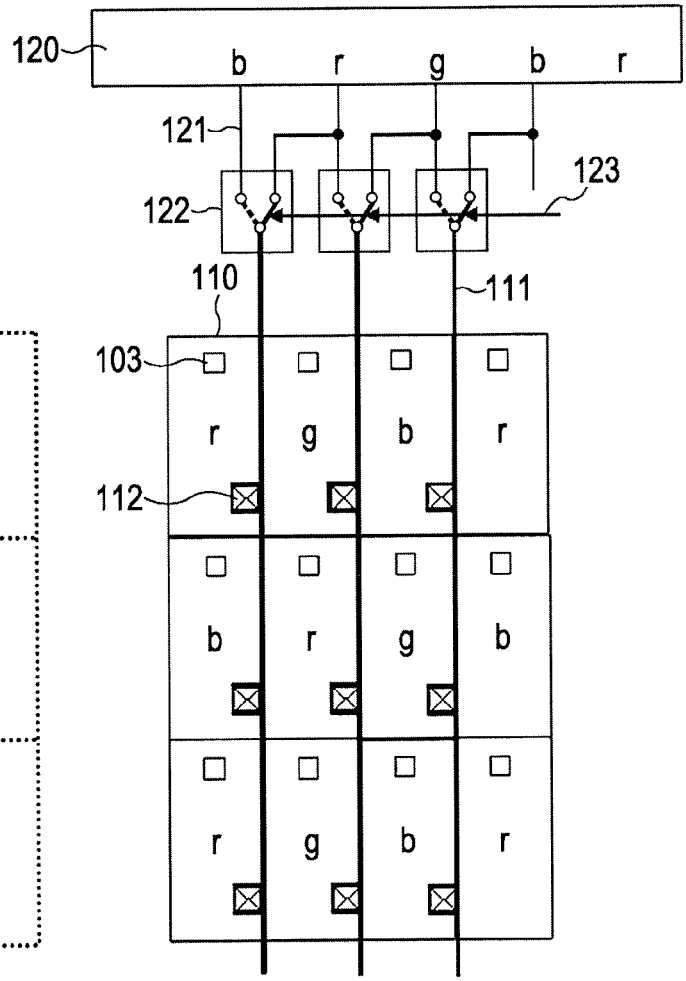

FIGS. 1A and 1B show a first example in which the present invention is applied to a matrix display device that employs the delta arrangement. The pixel circuit is exemplified in FIG. 4, where one signal line is extended in the column direction and two scanning lines are extended in the row direction.

FIG. 1A shows the delta arrangement of the EL elements. The EL element 101 (which is an inner small rectangular denoted by reference symbol R, G, or B) represents a light emitting region of the EL element of one color. The EL element at least includes an electroluminescent layer sandwiched between a pixel electrode 102 at a lower layer (which is an external large rectangular) and a common electrode (not shown) at an upper layer. The number of color types to be emitted by the EL elements is three including R, G, and B. The three colors are periodically expressed in the row direction. The light emitting region of the same color in the adjacent row is shifted (offset) in the row direction by 1.5 pixel pitch for arrangement.

FIG. 1B shows an arrangement of the pixel circuits. A rectangular region 110 denoted by reference symbol r, g, or b represents an area where circuit elements which are compositions of the pixel circuit shown in FIG. 4 such as the TFT, the capacitance, and connection wirings for connecting those elements one another are arranged. Hereinafter this region is referred to as pixel circuit region or simply referred to as pixel circuit.

"Pixel circuit" originally refers to an electric connection wiring represented in a circuit diagram but herein "pixel circuit" is used both for the original meaning and the circuit to which elements are specifically mounted. "Pixel circuit region" refers to an area occupied by the "pixel circuit" of the latter meaning, that is, "pixel circuit" that is an assembly of circuit elements formed of thin films or the like on a substrate. "Pixel circuit region" may also be referred to as "pixel circuit" in the meaning of an assembly of circuit elements in the region.

A pixel circuit region 110 is not necessarily rectangular. However, the pixel circuit region 110 corresponds to the EL element at the upper layer and therefore has the same shape and is also arranged at the same pitch as the EL element 101 in the row direction. In a case where the pixel circuit region is not rectangular, one grid is formed when a representative point in each region (for example, a top left edge) is removed, and thus it can be considered that FIG. 1B shows the grid.

As shown in FIGS. 1A and B, in contrast to the delta arrangement of the display element 102, a feature of the display device of the present invention resides in that the arrangement of the pixel circuit regions 110 forms a rectangular grid.

In FIG. 1B, although the inside of the rectangular region 110 is not drawn in detail, positions of a contact part 103 between the pixel circuit and the pixel electrode (hereinafter referred to as contact A) and a contact part 112 between the pixel circuit and the signal line (hereinafter referred to as contact B) are shown.

The pixel circuit region 110 of FIG. 1B is arranged under the EL element of FIG. 1A with the insulating layer (not shown) sandwiched therebetween. A grid shown by a dotted line of FIG. 1A represents a position of the pixel circuit region 110 at a lower layer of the EL element 102, and is matched to the grid of the rectangular pixel circuit region 110 in FIG. 1B.

The pixel circuit (which is simply referred to as pixel circuit 110) at the pixel circuit region 110 is connected to the pixel electrode 102 of the EL element 101 through the contact 103. The contact 103 is a contact hole opened at the insulating layer (not shown) and connects a drain electrode of the driver TFT in the pixel circuit (the TFT M44 of FIG. 4) at the lower layer to the pixel electrode 102 at the upper layer.

A current output terminal of the pixel circuit 110 denoted by A in FIG. 4 corresponds to the contact 103 in FIGS. 1A and 1B. A signal input terminal denoted by B of FIG. 4 is represented by a contact 122 in FIG. 1B.

As shown in FIGS. 1A and 1B, the positions of the pixel circuit region 110, the EL element 101, and the pixel electrode 102 are relatively displaced from one another. It should be noted that it is necessary for the pixel circuit and the pixel electrode 102 to be electrically connected through the contact 103, and thus the pixel circuit and the pixel electrode 102 need to be partially overlapped with each other as shown in FIG. 1A.

A positional relation among the pixel circuit region 110 and the EL element 101 (and the pixel electrode 102) is determined in the following manner.

In one row, for example, the first row in FIG. 1A, the pixel circuit region 110 is displaced with respect to the EL element 101 to the right by a distance shorter than the pixel pitch (this is set as x and the unit of x is one pixel pitch). In the next row, the second row in FIG. 1A, the pixel circuit region 110 is displaced to the left with respect to the EL element 101. This displacement is set as (½-x). Herein, x is the range of $0<x<½$. From the third row and then onward, repetition of the configurations of the first row and the second row is continued.

In this way, with respect to the delta arrangement of the EL element 101 of the pixel and the pixel electrode 102, the area of the pixel circuit 110 is relatively shifted in the inverted directions in adjacent rows. The sum of the displacement distances is ½ pixel pitch.

As a result of this displacement, the pixel circuit regions 110 are aligned not only in the row direction but also in the column direction and are arranged straight through. As shown in FIGS. 1A and 1B, the pixel circuit region 110 is set out in a grid.

The arrangement of the EL element 101 has a shift with respect to the adjacent row by 1.5 pixel pitch, and therefore the R pixel in the first row and the B pixel in the second row has a positional relation of ½ pixel pitch shift.

Therefore, when the pixel circuits 110 arranged straight through are sorted with regard to the colors of the EL elements driven by the pixel circuits, the pixel circuit of r is followed by the pixel circuit of b in the next row, the pixel circuit of g is followed by the pixel circuit of r in the next row, and the pixel circuit of b is followed by the pixel circuit of g in the next row. (Hereinafter, R, G, and B in capital letters represent colors of pixels composed by the EL element 101 and the pixel electrode 102, and r, g, and b in small letters represent colors of the EL elements that are driven by the pixel circuits 110. The above-described configurations accordingly explain the meanings of R, G, and B added to the EL element of FIG. 1A and r, g, and b added to the pixel circuits of FIG. 1B.)

The distance x by which the pixel circuit region 110 is shifted with respect to the EL pixel is determined on the basis of the position of the contact 103 inside the pixel circuit 110.

If the arrangement patterns of the pixel circuit 110 and the like (hereinafter also referred to as pixel circuit patterns) are congruent in all pixels (for purposes of illustration, a congruent relation is established when two shapes are identical to each other when the two shapes are overlapped without reversal), the position of the contact 103 inside the pixel circuit region 110 is determined (as a drain position of the TFT 43).

When this position is right at the center of the pixel circuit region 110 in the left and right direction, the pixel circuit is displaced by ¼ pixel pitch in each adjacent row in the inverted direction. With this structure, the position of the contact 103 with respect to the pixel electrode 102 of the EL pixel is located at a bilaterally-symmetric position in adjacent rows.

When the contact 103 is not located at the center in the pixel circuit region 110 and is displaced to the left, the displacement amount of the pixel circuit region 110 is set larger than ¼ in an odd-numbered row with respect to the relevant row (a row where the displacement in the right hand direction can be made with respect to the arrangement of the EL element) and the displacement amount of the pixel circuit region 110 is set smaller than ¼ in an even-numbered row (a row where the shift in the left hand direction can be made with respect to the arrangement of the EL element. When the contact 103 is displaced in the right, the opposite is correct.

In either case, under a condition where the displacing directions are opposite to each other in adjacent rows and the sum of the displacing distance is set to ½ pixel pitch, the displacing distance x is determined so that the positions of the contact A are bilaterally-symmetric in the even-numbered row and the odd-numbered row.

A thickness of the EL light emitting layer in the pixel is not constant and has a distribution. Thus, if the contact A at the contact hole is located at an asymmetric position as viewed from the pixel electrode, due to a difference of a current path in the pixel electrode surface, a difference in the light output power is generated. This difference is generated in the unit of row and is likely to be obvious as display unevenness. By arranging the contact A in a bilaterally-symmetric way, the current distribution becomes symmetric and the difference is eliminated.

In the above, the shift of the pixel array by 1.5 pixel pitch in adjacent rows has been described. However, it is possible to similarly displace the pixel circuit region with respect to a pixel array for other pixel arrangements with a shift by a pixel pitch multiplied by a non-integer such as 1.6 pixel pitch or 0.5 pixel pitch. In either case, the distance x by which the displacement can be made in each row must be within 1 pixel pitch. If the displacement amount is equal to or larger than 1 pixel pitch, the overlap part between the pixel circuit region and the display element region is lost and the electrical connection with use of the contact hole cannot be effected. With consideration of the size a of the contact hole, that is, the dimension in the row direction (a is set with the pixel pitch as a unit), the distance x by which the displacement can be made is further limited as much as $x<(1-a)$. In practice, x is considered to be as high as about ½.

It should be noted that the sum of the displacement amounts in adjacent rows is set to ½ pixel pitch in the above description, but this also varies due to the shift of the pixel array in the adjacent row. The sum of the displacement amounts is the same as the shift of the pixel array or equal to its fractional portion. In the case of 1.6 pixel pitch, the sum of the displacement amounts is 1.6 pixel pitch or 0.6 pixel pitch. After considering the limitation on the contact hole width, the fractional portion becomes the sum of the displacement amounts in reality.

In view of the difference in colors, the arrangement of the pixel circuits 110 has a shift of 1 pixel pitch in adjacent rows. However, as the pixel circuits are arranged straight through not only in the row direction but also in the column direction, it is possible to arrange the signal line 111 straight through along the edge of the pixel circuit region 110. FIG. 1B shows a signal line arranged straight through. It should be noted that, arranging the signal line straight through is effected in a region for the pixel array, that is, in the display unit, but is not necessarily effected in a peripheral region.

The signal line 111 is formed with a constant width in the column direction. If the signal line becomes a bent wiring, it is necessary to prepare a large area for the mounting pattern. With use of the straight signal line, the occupying area can be made smaller.

The signal line 111 and the pixel circuit region 110 are connected via a node point denoted by B in FIG. 4. In FIG. 1B, this is represented by the contact 112 between the signal line 111 and the pixel circuit region 110. The contact 112 is a connection between the drain electrode of the transistor M43 in FIG. 4 and the signal line 111. In a normal TFT fabrication process, the drain electrode and the signal line are formed on the same metal layer, and therefore the contact 112 is not a contact hole opened on the insulating layer but the contact 112 is formed in such a manner that the shape of the signal line (pattern) is extended to the drain position of the transistor M43.

The position of the contact 112 depends on the position of the transistor M43 in the pixel circuit, and therefore the position is not necessarily located at the position shown in FIG. 1B. However, with the same pixel circuit pattern, the position of the contact B becomes unchanged.

Use of the uniform pixel circuit pattern at least in the pixels in the column direction is easy in this case where the pixel circuit regions 112 are aligned straight through. If the pixel circuit regions 112 are not aligned straight through and the positions are displaced to each other, the positional relation of the circuit elements in the pixel circuit with respect to the straight signal line varies in every row, and thus it is difficult to set the patterns uniform.

When the positions for the contact 112 are aligned, the signal line can make a contact with the pixel circuit on one side, that is, on the right hand side or the left hand side with respect to the extending direction. FIG. 1B shows an example where the signal line makes a contact with the pixel circuit only on the right hand side with respect to the extending direction.

In the adjacent row, the pixel circuit is shifted only by 1 pixel pitch. Thus, while a connection is made with the pixel circuit alternately on both sides of one signal line in every other row, it is possible to connect one signal line to pixel circuits expressing one of the colors. However, in that case, the distance from the signal line 111 to the contact 112 has a longitudinal variety in every row, or the pixel circuit pattern needs to be inverted. This configuration leads to a difference in characteristics of the pixel circuit in every row, which may cause an influence on the display quality.

The signal line 111 transmits a display signal output at line 121 from a column control circuit 120 to the pixel circuit 110. A switch 122 is provided between the signal line 111 and the column control circuit 120 for every signal line. All the switches 122 are operated in conjunction with one another and are switched over at the same time in response to a signal of a common control line 123.

The switch 122 has two terminals on a side of the column control circuit 120, that is, on a signal input side, and one of which is connected to an output terminal. The output terminal functions as the signal line 111 as it is.

An r output 121 functioning as one of the column control circuits is connected to one input terminal of one of the switches 122, and a g output 121 of the adjacent column control circuit is connected to the other input terminal of the same switch. The g output is also connected to an input terminal of the adjacent switch at the same time.

In this way, the adjacent switches 122 have one column control signal output 121 as a common input, and this input is output to an output terminal of the either switch. As a result, each of the column control signal outputs 121 is output to mutually different signal lines, and is output to the adjacent signal line 111 in a column shifted by one column in response to the switching over of the switch 122.

The adjacent switches are operated in conjunction with each other, and the common input is not output to two signal line at the same time. Therefore, the output 121 of the column control circuit 120 is connected to the signal line one by one all the time.

The switches 122 are switched over in synchronism with the sequent scanning in every row by the scanning line. When the odd-numbered row is scanned over, the switch is switched to one side, and when the even-numbered row is scanned over, the switch is switched to the other side.

While it is set that the top row in FIGS. 1A and 1B is the odd-numbered row and the next row is the even-numbered row, when the first row is selected, the column control signal output 121 of r passes the switch 122 and the signal line 111 to be supplied to the pixel circuit of r. When the row selection is transferred to the second row, on the same signal line, the column control signal output of g passes the switch and the signal line to be supplied to the pixel circuit of b in the second row. Operations for other signal lines are the same as the above.

In this way, by switching over the switch 122 by one row each, the output of one column control circuit is transmitted to the pixel of the same color all the time. With this structure, it is unnecessary to shuffle the signals in the column control circuit 120 and simplify the configuration of the column control circuit.

In the case of a non-interlace driver method of sequentially selecting rows, as described above, the respective switches are switched over in the unit of the row scanning period.

In the case of an interlace driver method of selecting every other row, in one field, the signal line is connected to the pixel circuit of one color, and the next field as well, and the signal line needs to be connected to the pixel circuit of another color different from that of the previous field. Therefore, the switches 122 are switched over in the unit of the field.

In the pixel circuit according to this embodiment, all the layouts of the circuit elements are similar. This is because it is possible to make a contact with the pixels on one side as the result of aligning the pixels. Without the inversion of the patterns, it is also possible to eliminate the unevenness over the circuit characteristics in the unit of the row. Furthermore, as the pixel circuits are arranged and aligned in the stripe manner, there are no unnecessary protrusions in the end parts of the columns. In addition, the switch 122 can be realized with use of a simple circuit, and the area for the frame of the display device and the external size are hardly increased.

According to the first embodiment, the switch is provided between the column control circuit and the signal line, but without the provision of this switch, the output of the column control circuit is directly connected to the signal line, and data to be input to the column control circuit can be prepared while being shifted by one column in every row.

COMPARISON EXAMPLE 1

Figure 7A:
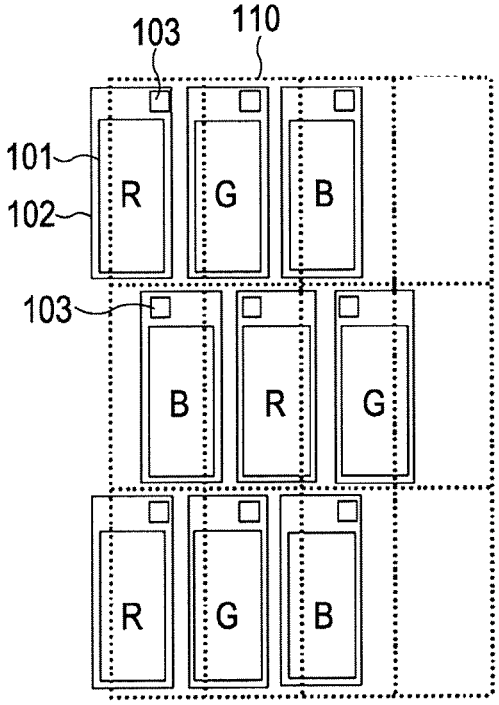
FIGS. 7A and 7B are arrangement drawings of pixel circuits according to Comparison Example 1 of the present invention.
Figure 7B:
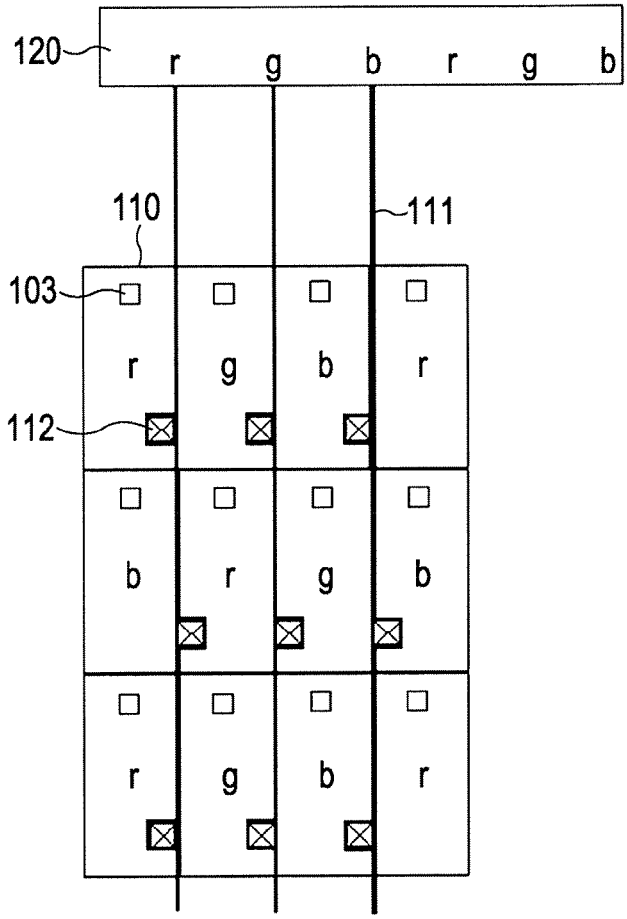

FIGS. 7A and 7B show a layout pattern of the display device in which the pixel circuits 110 are arranged on the left hand side and on the right hand side of one signal line 111 in every other row. The arrangement pattern of the circuit elements in the respective pixel circuits are inverted in every row.

The relation between the pixel circuit and the pixel electrode indicates that with respect to the pixel electrodes of the delta arrangement, the pixel circuit is displaced in one row by ¼ pixel pitch to the right and the pixel circuit is displaced in the next row by ¼ pixel pitch to the left.

In this arrangement, the respective signal lines are connected to the pixel circuits of the same color, and therefore no switches 122 are needed.

As a result of the difference in the characteristic of the pixel circuit in each row, it is also possible to make the layout patterns of the circuit elements in the pixel circuits 110 all congruent.

However, at that time, it is necessary to locate the contact 112 at the center of the pixel circuit 110 and to set the distance between the signal line 111 and the contact 112 equal in all the pixels. Furthermore, in order that a contact hole 103 as viewed from the pixel electrode 102 is located at a bilaterally-symmetric position in the adjacent row, the contact hole 103 also needs to be located at the center of the pixel circuit 110. This arrangement significantly limits the degree of design freedom.

Second Embodiment

Figure 5:
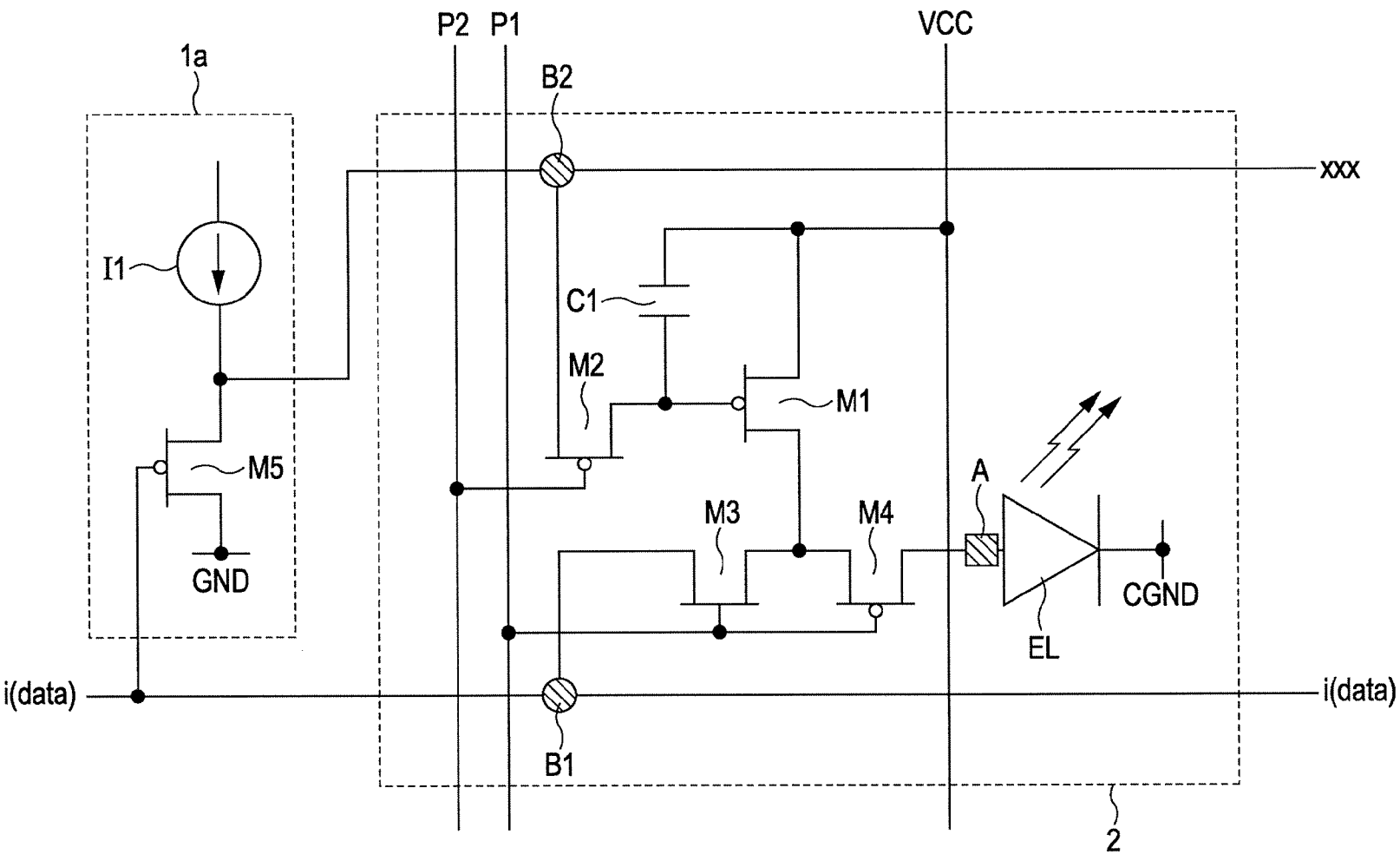
FIG. 5 shows an example of a pixel circuit in which the number of control lines is two.
Figure 6:
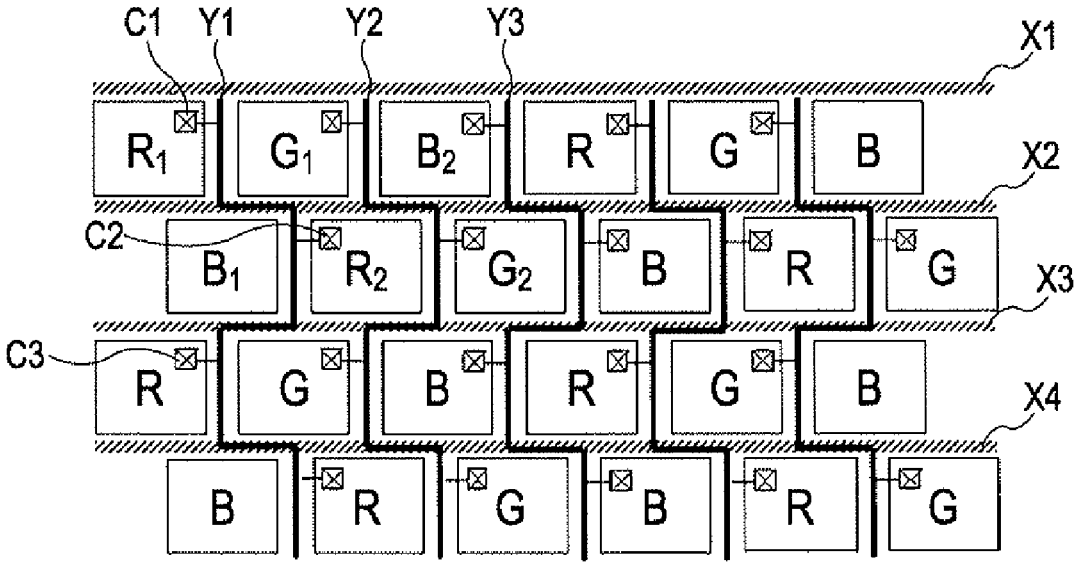
FIG. 6 shows an example of a display device in which pixels are arranged in a delta shape.

FIG. 5 shows another pixel circuit, which is different from that in FIG. 4, proposed in US Patent Laid-Open No. 2004/0066357.

The scanning lines P1 and P2 in FIG. 5 supply the same signals of the scanning lines P1 and P2 in FIG. 4. The TFTs M1, M2, M3, and M4 respectively correspond to the TFTs M41, M42, M43, and M44 of FIG. 4 and have the same function.

As for differences from FIG. 4, the two signal lines i(data) and xxx are connected to the pixel circuit 2 of FIG. 5. The signal line i(data) supplies a current signal and the signal line xxx supplies a voltage signal. Then, M42 of FIG. 4 is located between the gate and the grain of the driver TFT, whereas M2 of FIG. 5 is connected to the signal line xxx.

The voltage signal of the voltage signal line xxx is generated at an auxiliary signal source 1*a*. One auxiliary signal source 1*a* is provided for each column. The auxiliary signal source 1*a* is composed of a constant current source I1 and a source follower circuit of the TFT M5. The current signal line i(data) is connected to the gate of M5, and therefore the voltage of the current signal line i(data) becomes a signal of the voltage signal line as it is due to the source follower. In the pixel circuit 2, this voltage signal is input to the gate of the driver TFT M1, and therefore a voltage in accordance with the current signal is charged at the capacitance C1 between the gate and the source.

A in FIG. 5 denotes a connection point between the pixel circuit and a current injection terminal of the EL element, B1 denotes a connection point between a first signal line i(data) and the pixel circuit (a conductive terminal of the TFT M3), and B2 denotes a connection point between a second signal line xxx and the pixel circuit (a conductive terminal of the TFT M2). The first signal line i(data) and the second signal line xxx are formed on a source-drain wiring layer used for a conductive terminal connection of the transistor.

Figure 2A:
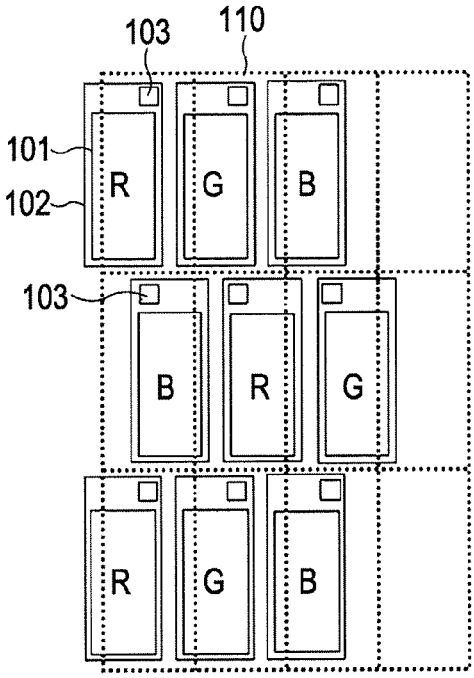
FIGS. 2A and 2B are arrangement drawings of pixel circuits according to a second embodiment of the present invention.
Figure 2B:
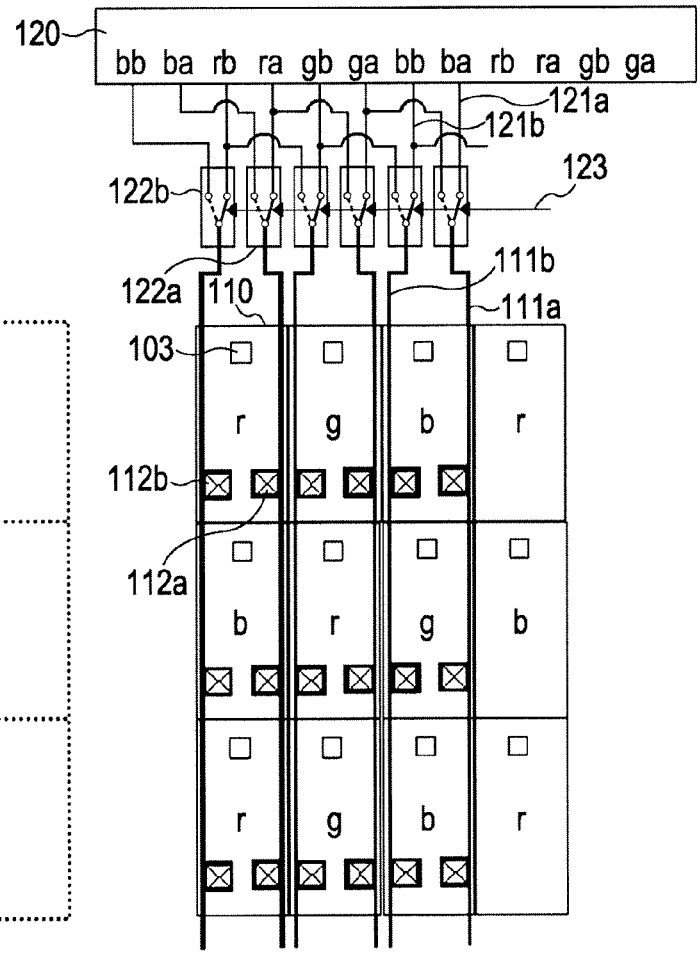

FIGS. 2A and 2B show that the present invention is applied to the display device provided with the pixel circuit in FIG. 5, and also show the arrangement of the EL pixel that employs the delta arrangement and its driver circuit.

In FIGS. 2A and 2B, there are provided two signal lines 111*a* and 111*b*, which respectively supply the current signal and the voltage signal to the pixel circuit. In accordance with the provision of two signal lines, contacts 112*a* and 112*b* of the pixel circuit are also provided at two positions and there are two switches 122*a* and 122*b* and two signal outputs 121*a* and 121*b* of the column control circuit 120 as well.

The contacts 112*a* and 112*b* corresponding to signal input terminal B1 and B2 of the pixel circuit 2 in FIG. 5 respectively represent patterns of extended parts of the signal lines 111*a* and 111*b* to source terminals of the transistors M3 and M2.

The pixel patterns are all configured to be identical and there are no inverted patterns. The positional relation with respect to the pixel electrode is the same as FIGS. 1A and 1B. The pixel circuits 110 are aligned straight through, and the signal lines 111*a* and 111*b* are both straight lines and arranged on the left and right side of the region of the pixel circuit 110. The two signal lines 111*a* and 111*b* are connected to the pixel circuit 110 with the contact parts 112*a* and 112*b* provided on one side.

The switches 122*a* and 122*b* are structured so as to be operated all in conjunction with each other.

A ba output terminal which is adjacent to an ra output terminal of the column control circuit 120 on the left hand side is connected to the input side of one switch 122*a*. The signal line 111*a* is connected to the output side of the switch 122*a*. A bb output terminal which is adjacent to an rb output terminal of the column control circuit 120 on the left hand side is connected to the input side of the switch 122*b*. The signal line 111*b* is connected to the output side of the switch 122*b*. Other switches also have the same configuration.

There are two types, an a system and a b system, for the switch and the input and output thereof. Each of the switches executes the same function as the switch of the first embodiment.

According to this embodiment, there is used the pixel circuit whose number of the signal lines that are switched over in response to the corresponding display control signal in the adjacent column by the switch group is 2. A similar function can also be realized if the switch group is composed in accordance with the signal lines when the pixel circuit whose number of signal lines is 3 or larger is used.

In a case where two signal lines are provided and one of which is a constant voltage source or the signal lines supply the same signals to two rows, it is unnecessary to provide a switch for the signal lines for switching over in every row. In that case the switch for the signal line may be eliminated.

COMPARISON EXAMPLE 2

Figure 8A:
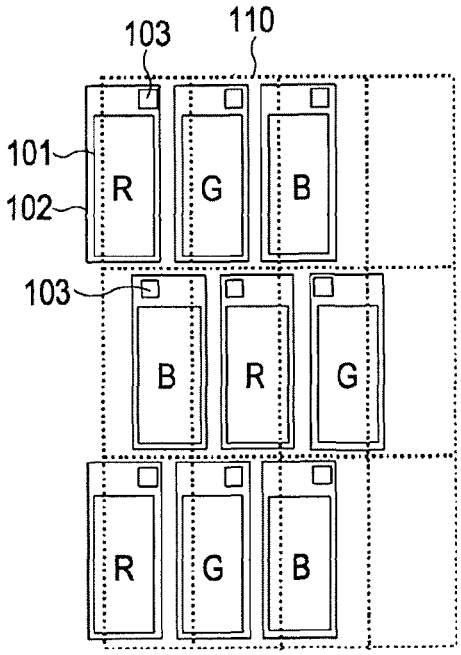
FIGS. 8A and 8B are arrangement drawings of pixel circuits according to Comparison Example 2 of the present invention.
Figure 8B:
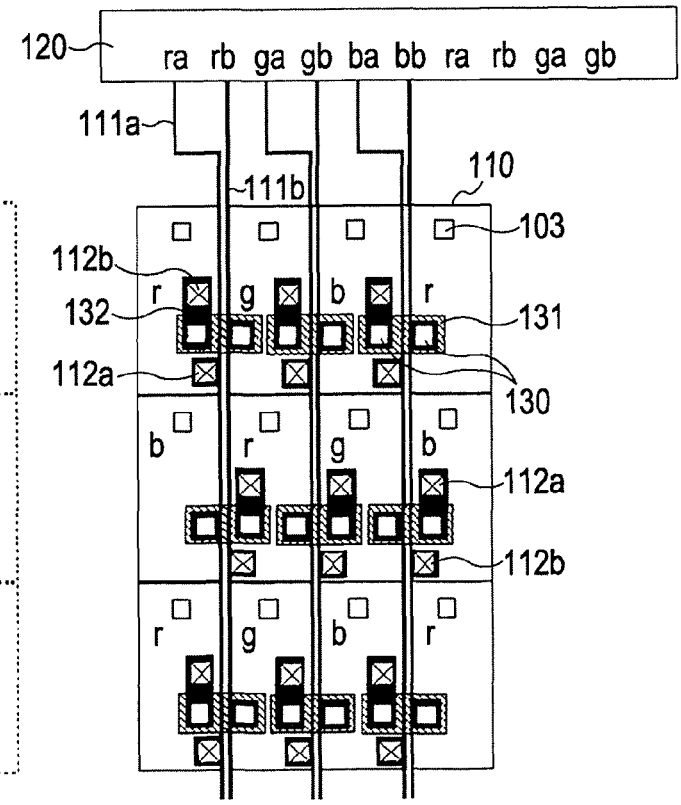

FIGS. 8A and 8B show another layout pattern of the circuit provided with the two signal lines, which is the same as the third embodiment shown in FIG. 5.

The difference from FIGS. 2A and 2B resides in that the two signal lines 111*a* and 111*b* are both arranged close to one side of the pixel circuit 110 and the pixel circuit 110 are connected to alternately both sides of the signal line in every adjacent rows.

The one pair of the signal lines 111*a* and 111*b* is connected to the pixel circuit of the same color, and it is not necessary to provide the switches 122*a* and 122*b* as in the second embodiment.

However, while the two signal lines can be extended to the contact 112*a* in the odd-numbered row, in the even-numbered row the signal line 111*a* is intersected with the signal line 111*b* to be connected to the contact 112*b*. The same applies to the signal line 111*b*, except that the even-numbered row and the odd-numbered row are exchanged.

If the wiring from the signal line to the contact is intersected with the other signal line, the signal line needs to be wired via a different wiring layer with the intermediation of the gate wiring layer, for example, via the insulating layer at the intersection part. When the odd-numbered row is considered as an example, through holes 130 are provided on the insulating layer (not shown) at two positions on both sides of the intersection part. The signal line 111*b* is connected to a gate wiring layer 131 via the through hole. The gate wiring layer 131 passes below the other signal line 111*a* to be intersected and then returns from the through hole 130 again to the signal line layer 132. The signal line layer 132 is extended to the contact 112*b* to achieve a contact with the pixel circuit. When two through holes are provided, the through holes occupy the large area. Thus, the arrangement of the other circuit elements is slightly tight.

Third Embodiment

Figure 9A:
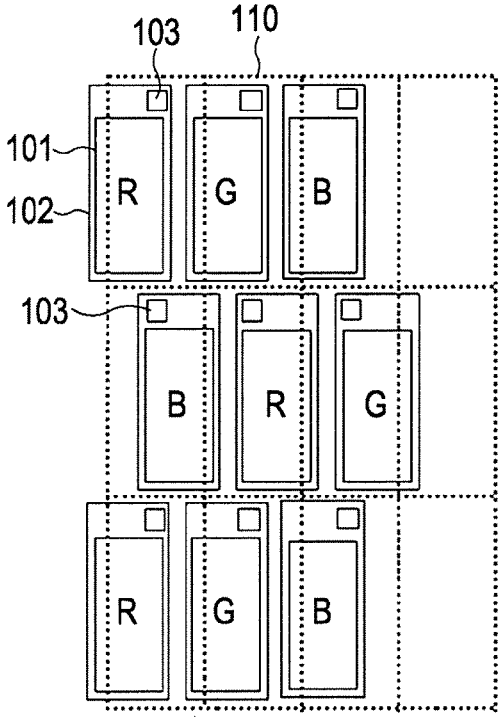
FIGS. 9A and 9B are arrangement drawings of pixel circuits according to a third embodiment of the present invention.
Figure 9B:
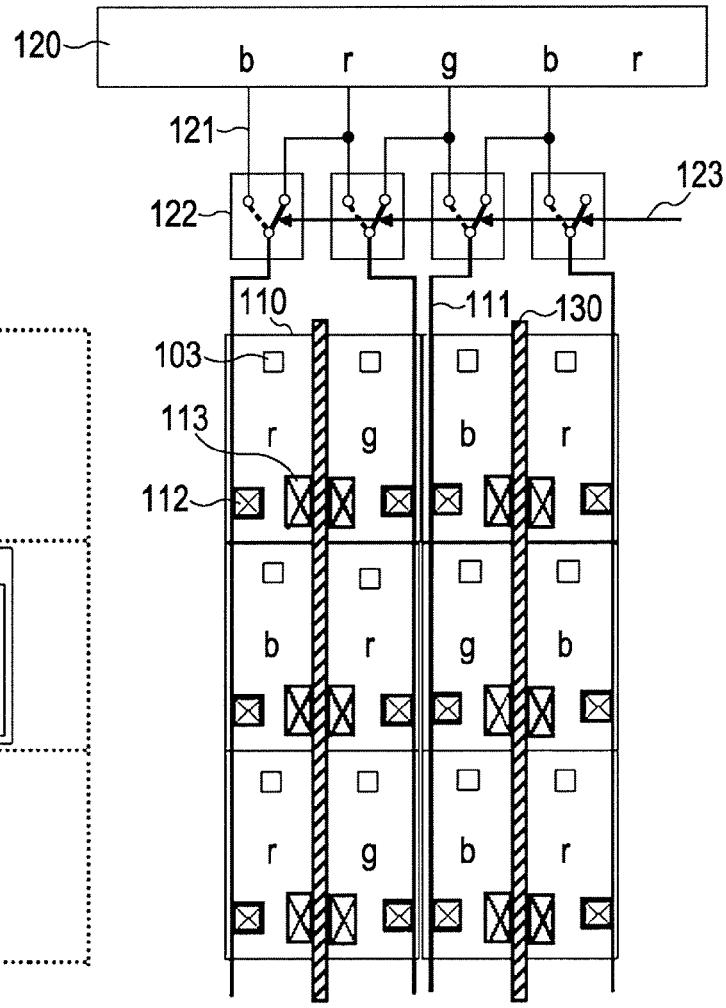

FIGS. 9A and 9B show a pixel array according to a third embodiment of the present invention. As this embodiment is different from the first embodiment, in addition to the signal line 111, a power source line 130 is further provided in the column direction. The power source line 130 supplies a driver current to the pixel circuit 110, and it is thus necessary to use a wiring with a wide width to have a low resistance. After all it is preferred to extend the power source line straight through. For that reason, the signal lines 111 are extended straight through alternately in other rows along the left or right frame of the pixel circuit region 110, and the power source line 130 is arranged along the pixel circuit region without the signal line in between. The power source line 130 supplies currents to the pixel circuits 110 on both the sides via a contact part 131. The power source line 130 is commonly used in two columns. Then, the arrangement of the circuit elements in the respective pixel circuits 110 are horizontally inverted patterns in other columns.

Other points are the same as those in the first embodiment.

While the present invention has been described with reference to exemplary embodiments, it is to be understood that the invention is not limited to those embodiments. The scope of the following claims is to be accorded the broadest interpretation so as to encompass all modifications, equivalent structures and functions.

This application claims the benefit of Japanese application No. 2006-098012 filed Mar. 31, 2006, which is hereby incorporated by reference herein in its entirety.

What is claimed is:

1. A display device, comprising:

display elements expressing one of a plurality of colors and composing a pixel, wherein the display elements are arranged in the row direction and the column direction so as to express colors in a periodic arrangement, and wherein in the row direction, the display elements are shifted with respect to an adjacent row by a pixel pitch multiplied by a non-integer;

pixel circuits that drive the respective display elements;

scanning lines that transmit a row selection signal to the pixel circuits; and signal lines each of which is disposed for a column of each of the pixel circuits, and each of which is disposed straight through in the column direction and transmits a signal, wherein a plurality of the pixel circuits connected to the same signal line drive display elements of different colors between the adjacent rows, in accordance with an arrangement of the colors displayed by the display elements, wherein each of the pixel circuits includes a plurality of circuit elements which are arranged in an area with a same pattern at least in the column direction, and wherein the pixel circuits are disposed straight through in the column direction and the display elements driven by the pixel circuits adjacent in the column direction are shifted in opposite directions with respect to the pixel circuits.

2. The display device according to claim 1, wherein the arrangements of the circuit elements in two adjacent columns are symmetric with respect to an axis parallel to the column direction, and a power source line extending in the column direction is arranged between two signal lines in the adjacent columns.

3. The display device according to claim 1, wherein two signal lines are provided in a column, one of which is connected to the pixel circuit only at one side, and the other is connected to the same pixel circuit on the opposite side to the one signal line.

4. The display device according to claim 1, wherein the shift of the arrangement of the display element to that in the adjacent row is 1.5 pixel pitch, and a sum of absolute values of relative displacement of the pixel circuit to the display element is ½ pixel pitch.

5. The display device according to claim 1, wherein the pixel circuit and the display element are arranged while having an overlap and are electrically connected to each other via a contact hole, and the contact hole in the display element is located at an inversion symmetrical position in every adjacent row.

6. The display device according to claim 5, wherein the contact hole is on a center axis of the pixel circuit, and relative displacements of the pixel circuits to the display elements in two adjacent rows have a same absolute value.

7. The display device according to claim 5, wherein the contact hole is located off the center of the pixel circuit to a left or a right side, and relative displacements of the pixel circuits to the display elements in two adjacent rows have different absolute values.

8. A display device in which a plurality of pixels are arranged in a row direction and a column direction, comprising:

display elements expressing one of a plurality of colors and composing a pixel, wherein the display elements are arranged in the row direction and the column direction so as to have colors in a periodic arrangement which is shifted with respect to an adjacent row by a pixel pitch multiplied by a non-integer;

pixel circuits that drive the display elements;

scanning lines that transmit a row selection signal to the pixel circuits;

signal lines that transmit a display signal to the pixel circuits; and column control circuits that generate and output a display signal for every column, wherein a plurality of the pixel circuits connected to a same signal line drive the display elements of different colors between the adjacent rows in accordance with an arrangement of the colors displayed by the display elements, wherein each of the pixel circuits includes a plurality of circuit elements arranged in an area with a same pattern at least in the column direction, and wherein the pixel circuits are displaced relative to the display elements in opposite directions in adjacent rows;

wherein the signal lines are straight-line wirings extending in the column direction in a region where the display elements are arranged, and are connected only to pixel circuits aligning in one column along which the respective signal lines extend in the column direction; and wherein an output of the column control circuit and the signal line are connected to each other via a switch, and wherein the switch performs a shift of the connection between the output of the column control circuit and the signal line by one column.

9. The display device according to claim 8, wherein the switch is switched in synchronism with a row selection of the scanning line.

10. The display device according to claim 8, wherein a row selection of the scanning line is sequentially performed in every other row, and the switch is switched over in every field where an even number and an odd number of the selected row are exchanged.

* * * * *